United States Patent [19]

Diaz et al.

[11] Patent Number: 5,073,469

[45] Date of Patent: Dec. 17, 1991

[54] TONER COMPOSITIONS

[75] Inventors: Arthur F. Diaz; Daphne L. Wollmann, both of San Jose, Calif.

[73] Assignee: Lexmark International, Inc., Greenwich, Conn.

[21] Appl. No.: 565,286

[22] Filed: Aug. 9, 1990

[51] Int. Cl.[5] ..... G03G 9/097

[52] U.S. Cl. ..... 430/110

[58] Field of Search ..... 430/110

[56] References Cited

U.S. PATENT DOCUMENTS

| | | | |
|---|---|---|---|
| Re. 32,883 | 3/1989 | Lu | 430/110 |
| 2,891,011 | 6/1959 | Insalaco | 430/110 X |
| 3,502,582 | 3/1970 | Clemens et al. | 430/107 |
| 3,850,642 | 11/1974 | Bailey, Jr. et al. | 96/87 A |
| 3,870,841 | 3/1975 | Makowski et al. | 260/23.7 R |
| 4,012,560 | 3/1977 | Baatz et al. | 428/474 |
| 4,296,016 | 10/1981 | Randin | 260/29.6 SQ |
| 4,302,201 | 11/1981 | Hasegawa et al. | 430/106 X |
| 4,397,935 | 8/1983 | Ciccarelli et al. | 430/110 |
| 4,411,974 | 10/1983 | Lu et al. | 430/106 |
| 4,478,991 | 10/1984 | Huang et al. | 526/287 |
| 4,560,635 | 12/1985 | Hoffend et al. | 430/106.6 |
| 4,654,175 | 3/1987 | Lu et al. | 260/501.15 |
| 4,762,764 | 8/1988 | Ng et al. | 430/115 |
| 4,772,528 | 9/1988 | Larson et al. | 430/115 |
| 4,777,104 | 10/1988 | Matsumoto et al. | 430/109 |
| 4,797,339 | 7/1989 | Maruyama et al. | 430/109 |
| 4,837,391 | 6/1989 | Anderson et al. | 430/110 |
| 4,837,392 | 6/1989 | Anderson et al. | 430/110 |
| 4,837,393 | 6/1989 | Alexandrovich et al. | 430/110 |
| 4,837,394 | 6/1989 | Alexandrovich et al. | 430/110 |
| 4,883,735 | 11/1989 | Watanabe et al. | 430/109 |
| 4,894,308 | 1/1990 | Mahabadi et al. | 430/137 |

*Primary Examiner*—Roland Martin

*Attorney, Agent, or Firm*—John A. Brady

[57] ABSTRACT

The present invention relates to toner compositions containing a negative charge-enhancing additive useful for developing latent electrostatic images to visible images.

17 Claims, No Drawings

TONER COMPOSITIONS

FIELD OF THE INVENTION

The present invention relates to dry-type toner materials for developing latent electrostatic images to visible images for use in electrophotography, electrostatic recording methods, and electrostatic printing methods.

DESCRIPTION OF RELATED ART

Toner compositions containing charge-enhancing additives are known in the prior art, particularly those toners containing charge-enhancing additives which impart a positive charge to the toner resin. Such toners are used alone in monocomponent electrophotographic developers or may be mixed with a suitable carrier vehicle for use in dual-component developers. However, fewer toner compositions are known in the art wherein charge-enhancing additives are employed for the purpose of imparting a negative charge to the toner resin.

Lu et al., U.S. Pat. No. 4,411,974, "Ortho-Halo Phenyl Carboxylic Acid Charge Enhancing Additives", issued Oct. 25, 1983, disclose negatively chargeable toner compositions comprised of resin particles, pigment particles, and as a charge-enhancing additive, ortho-halo phenyl carboxylic acids.

Anderson et al., U.S. Pat. No. 4,837,391, "Dry Electrostatographic Developer Containing Toner Particles Comprising a Vinyl Addition Polymer Containing a Covalently Bound Quaternary Phosphonium Salt", issued Jun. 6, 1989, disclose negatively chargeable toner compositions comprised of vinyl addition polymers as binders and a charge control agent comprising a quaternary phosphonium salt.

Watanabe et al., U.S. Pat. No. 4,883,735, "Negatively Chargeable Toner for Use in Dry Electrophotography", issued Nov. 28, 1989, disclose a toner comprised of a resinous binder, a coloring agent, and a negatively chargeable control agent comprising a copolymer having a molecular weight of from 2,000 to 15,000 and composed of a styrene monomer and an N-alkyl (meth-)acrylamide monomer having a sulfonic acid substituent.

Although the toners of the aforementioned references, the disclosures of which are incorporated herein by reference, contain negatively chargeable control agents, there remains a need for toners containing a negatively chargeable control agent which has improved compatibility with binder resin formulations, as well as exhibiting effective triboelectric properties.

It is therefore an object of this invention to provide a toner composition which employs a negatively chargeable control agent which is compatible with binder resin.

Other objects and advantages will become apparent from the following disclosure.

SUMMARY OF THE INVENTION

The present invention relates to a toner for developing latent electrostatic images comprising (a) a binder copolymer comprising a styrene monomer and an acrylate ester monomer; and (b) a negatively chargeable copolymer comprising a styrene monomer having a sulfo substituent and an acrylate ester monomer, said copolymers each independently having a molecular weight greater than about 25,000. Preferably, the acrylate ester monomer in the negatively chargeable copolymer has the same chemical structure as the acrylate ester monomer in the binder copolymer.

The toner composition also optionally contains a colorant. The negatively chargeable copolymer of the present invention exhibits improved compatibility with the binder resin.

A more thorough disclosure of the present invention is presented in the detailed description which follows.

DETAILED DESCRIPTION OF THE INVENTION

The present invention relates to a toner for developing latent electrostatic images to visible images comprising (a) a binder copolymer comprising a styrene monomer and an acrylate ester monomer; and (b) a negatively chargeable copolymer comprising a styrene monomer having a sulfo substituent and an acrylate ester monomer, said copolymers each independently having a molecular weight greater than about 25,000. Preferably, the acrylate ester monomer in the negatively chargeable copolymer is the same as the acrylate ester monomer in the binder copolymer.

The binder copolymer comprises at least one comonomer selected from styrene or alphamethylstyrene (collectively herein referred to as "styrene") and an acrylate ester comonomer. Preferred acrylate ester comonomers include alkyl acrylates where alkyl is linear or branched, having 1 to 10 carbon atoms. Suitable alkyl acrylates include methyl acrylate, ethyl acrylate, propyl acrylate, 2-ethylhexyl acrylate, butyl acrylate, and the like; and alkyl (meth)acrylates such as methyl (meth)acrylate, ethyl (meth)acrylate, butyl (meth)acrylate, propyl (meth)acrylate, amyl (meth)acrylate, 2-ethylhexyl (meth)acrylate, cyclohexyl (meth)acrylate, lauryl (meth)acrylate, and stearyl (meth)acrylate. These may be used singly or in combination. Preferred acrylate esters are butyl (meth)acrylate, butyl acrylate, and 2-ethylhexyl acrylate.

The ratio between the first monomer styrene and the second monomer acrylate ester, as the weight ratio of styrene to the acrylate ester, is generally from 40:60 to 90:10, preferably from 50:50 to 70:30. The binder copolymer preferably has a glass transition temperature (Tg) of about 60° to about 85° C., particularly 65° to 80° C. The binder copolymer has a molecular weight of greater than about 25,000, preferably about 25,000 to about 250,000, particularly about 60,000 to about 120,000. The binder copolymer can also be crosslinked, resulting in higher molecular weights. The binder copolymer has a gel content of from 0% to about 80%. The binder copolymer may also comprise mixtures of styrene/acrylate ester copolymers having different molecular weights and/or crosslink densities.

Preferred binder copolymers for use in the compositions of the present invention are poly(styrene-co-butyl methacrylate) sold by Hercules under the tradename PICCO, and poly(styrene-co-butyl acrylate) sold by Politribo Company under the tradename ZSR 1005. Other binder copolymers useful in the toners of the present invention will be known to those skilled in the art.

The binder copolymer may optionally contain a small proportion (preferably about 1% to about 4% by weight based on the weight of the polymer) of units of a third monomer. The third monomer may be a compound having two or more copolymerizable unsaturated groups per molecule. Examples include alkylene or di- or poly-alkylene glycol di(meth)acrylates such as ethylene glycol di(meth)acrylate, diethylene glycol di(meth)acrylate, polyethylene glycol di(meth)acrylate, propylene glycol di(meth)acrylate, and butanediol di(meth)acrylate; poly(meth)acrylates of polyhydric alcohols such as trimethylolpropane tri(meth)acrylate; and divinylbenzene and divinylnaphthalene. The use of these third monomers gives a copolymer partly having a three-dimensional crosslinked structure.

The binder copolymer may optionally be admixed with other types of binder resins, such as polyesters, and toners having other types of binder resins admixed with the binder copolymer and the negatively chargeable copolymer of the present invention are equivalent to the toner compositions of the present invention.

The negatively chargeable copolymer comprises an acrylate ester comonomer and a styrene (styrene or alphamethyl styrene) comonomer wherein at least a portion of the styrene comonomer units have a sulfo substituent ($-SO_3H$) on the aromatic ring. The degree of sulfonation of the styrene comonomer can vary from about 1 mole % to about 20 mole % (e.g., based on an aromatic ring being sulfonated in every 1 to about 20 repeating units of the polymer), preferably from about 2 mole % to about 8 mole %. The acrylate ester comonomer of the negatively chargeable copolymer preferably has the same chemical structure as the acrylate ester comonomer of the binder copolymer. However, toners having a negatively chargeable copolymer comprising a styrene/acrylate ester where the acrylate ester comonomer is a homolog or analog of the acrylate ester comonomer of the styrene/acrylate ester binder copolymer are equivalent to toner compositions where the acrylate ester monomers are the same.

The negatively chargeable copolymer has a molecular weight of greater than about 25,000, preferably about 25,000 to about 250,000, more preferably about 60,000 to about 120,000. In some cases, the negatively chargeable copolymer may be crosslinked and therefore may have a higher molecular weight. At molecular weights below about 25,000, the negatively chargeable copolymer will phase separate to hinder a uniform dispersion of the negatively chargeable copolymer in the binder copolymer. Most preferably, the negatively chargeable copolymer has a molecular weight substantially equal to the molecular weight of the binder copolymer. As described hereinbelow, the chargeable copolymer is preferably prepared by sulfonation of a separated portion of the binder copolymer, and therefore will have a molecular weight substantially equal to the molecular weight of the binder copolymer. The toner is made by admixing the negatively chargeable copolymer (sulfonated binder copolymer) with the unsulfonated binder copolymer. The negatively chargeable copolymer preferably also has about the same weight ratio of styrene to acrylate ester as the binder copolymer. Alternatively, the toner of the present invention can be made by low-level sulfonation of the bulk binder copolymer with a sulfonating agent, such as sulfur trioxide, to convert a small amount of the binder copolymer (e.g., about 0.1 mole % to about 1 mole %) to the negatively chargeable copolymer.

The negatively chargeable copolymer is preferably prepared by the unique method of direct sulfonation of a portion of the binder copolymer. A portion of the binder copolymer is mixed with a suitable organic solvent in a reaction vessel. Then acetic anhydride and sulfuric acid are added to the reaction mixture to sulfonate the styrene portion of the copolymer. The mixture is stirred and heated to complete the reaction. The reaction is quenched in a suitable alcohol to avoid transesterification and hydrolysis, and the product is isolated by standard chemical procedures. Other methods for preparation of the sulfonated negatively chargeable copolymer will be known to those skilled in the art.

The toner compositions of the present invention preferably contain a colorant material. Suitable dyestuffs or color pigments or carbon black pigments can be employed in toners of the invention as colorants. Such materials serve to color the toner and/or render it more visible. Suitable toner materials having the appropriate charging characteristics can be prepared without the use of a colorant material where it is desired to have a developed image of low optical density. Suitable colorants can, in principle, be selected from virtually any of the compounds mentioned in the Colour Index, Vols. 1 and 2, Second Edition.

Included among the vast number of useful colorants are such materials as Hansa Yellow G (C.I. 11680), Nigrosine Spirit soluble (C.I. 50415), Chromogen Black ETOO (C.I. 45170), Solvent Black 3 (C.I. 26150), Fuchsine N (C.I. 42510), and C.I. Basic Blue 9 (C.I. 52015). Carbon black also provides a useful colorant. The amount of colorant added may vary over a wide range, for example, from about 0.5 to about 15% of the weight of the toner. Particularly good results are obtained for color pigments from about 1 to about 5%, and for carbon black from about 1 to about 12%.

The toner composition may also contain other additives known to those skilled in the art such as silicone oil, hydrocarbon wax, and solid fillers such as silica, alumina, zinc oxide, and carbon black.

The color toner composition of the present invention contains about 88% to about 98.5 weight % of the binder copolymer (preferably about 88% to about 90%), and about 0.1% to about 5 weight % of the negatively chargeable copolymer (preferably about 0.5% to about 1.5%), and about 1% to about 11.5 weight % of a colorant. The amount of negatively chargeable copolymer in the composition will generally depend on the degree of sulfonation of the chargeable copolymer and the desired charge level for the developer materials and process conditions.

The components of the toner composition can be admixed in any convenient manner such as by melt-blending a mixture of the component and then the solidified melt is ground to desired size to form a free-flowing powder of toner particles.

Alternatively, the toner components can be solution blended in a volatile solvent such as dichloromethane and then atomized in a spray dryer to produce toner particles, as is well known.

Toner particles may have an average diameter between about 0.5 μm and about 50 μm, a value in the range from about 1.0 to about 20 μm being preferable for many currently used machines. However, larger or smaller particles may be needed for particular methods of development or development conditions.

To be utilized as toners in electrophotographic developers, the toner particles of the invention may be used alone in monocomponent developers or may be mixed with a suitable carrier vehicle known to those skilled in the art for use in dual component developers. The carrier vehicles which can be used to form developer compositions can be selected from various materials. Such materials include carrier core particles and core particles overcoated with a thin layer of film-forming resin to establish the correct triboelectric relationship and charge level with the toner employed.

The carrier core materials can comprise conductive, nonconductive, magnetic, or nonmagnetic materials. For example, carrier cores can comprise glass beads; crystals of inorganic salts such as aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, or oxidized iron; or mixtures or alloys of any of the foregoing. A suitable resin for coating includes various epoxy resins, fluorocarbons such as polytetrafluoroethylene, poly(vinylidene fluoride) and mixtures, and copolymers thereof.

The toner of this invention can be used in a variety of ways to develop electrostatic charge patterns or latent images. Such developable charge patterns can be prepared by a number of means and be carried, for example, on a light-sensitive photoconductive element or a nonlight-sensitive, dielectric-surfaced element such as an insulator-coated conductive sheet. One suitable development technique involves cascading the toner or developer composition across the electrostatic charge pattern, while another technique involves applying toner particles from a magnetic brush. After imagewise deposition of the toner particles, the image can be fixed, e.g., by heating the toner to cause it to fuse to the substrate carrying the toner. If desired, the unfused image can be transferred to a receiver such as a blank sheet of copy paper and then fused to form a permanent image.

The following examples are detailed descriptions of methods of preparations of certain toners of the present invention. The detailed preparations fall within the scope of, and serve to exemplify, the more generally described methods of preparation set forth above. These examples are presented for illustrative purposes only, and are not intended as a restriction on the scope of the invention.

EXAMPLE 1

Preparation of the Negatively Chargeable Copolymer (A) To a warm (50° C.) solution of 5 g of PICCO resin and 25 ml of 1,2-dichloroethane was added 0.53 ml acetic anhydride then 0.20 ml sulfuric acid, while stirring continuously. The resulting brown solution was stirred for one hour at 50° C., quenched by adding 6 ml butanol, then precipitated immediately into near-boiling water (85° C.). The solid was recovered, washed with distilled water, and then dried in a vacuum oven at 65° C to constant weight. The acid content of the copolymer as determined by titration was 920 μmole/g (17% sulfonated styrene units/total copolymer). NMR and IR spectra reflect the structure of the PICCO resin, and no carbonyl peak for a free carboxylic acid group appears in the IR spectrum. DSC and TGA analyses indicate Tg at 71° C., the presence of ca. 3% moisture, and thermal stability up to 200° C., with 10% weight loss at 250° C.

(B) To a warm (50° C.) solution of 5 g of ZSR 1005 resin and 5 ml of 1,2-dichloroethane was added 0.5 ml acetic anhydride and 0.2 ml $H_2SO_4$, while stirring continuously. The mixture was swirled manually to speed up mixing. The mixture was stirred for one hour at 50° C., quenched by adding 10 ml butanol, then precipitated immediately into near-boiling water (85° C.). The solid was recovered, washed with distilled water, and then dried to constant weight in a vacuum oven at 65° C. The acid content of the polymer was 970 μmole/g (18% sulfonated styrene units/total polymer). The IR spectrum reflects the structure of the resin with no evidence of carboxylic acid groups. DSC and TGA analyses indicate Tg at 79° C., the presence of 4% moisture, and thermal stability up to 250° C. (9% weight loss).

EXAMPLE 2

The toners were prepared by melt blending the binder resin, the charge control copolymer, and carbon black, and milling the product to an average particle size of 8 to 10 microns. Each toner composition comprised the following components:

| | | | |
|---|---|---|---|
| 1. | Toner A | PICCO binder | 90.5-91.5% |
| | | Sulfonated PICCO | 0.5-1.5% |
| | | Carbon Black | 8% |
| 2. | Toner B | ZSR 1005 | 90.5-91.5% |
| | | Sulfonated ZSR 1005 | 0.5-1.5% |
| | | Carbon Black | 8% |

The toner was then mixed at 2.5 weight % level with a 200 micron iron carrier which was coated with epoxy binder. This combination was then can-rolled for 30 minutes to achieve a steady state charge.

The charging value, Q/M in microcoulombs/gram, was determined by the total blowoff method, where the toner/carrier mix is placed in a Faraday cage and the toner is blown away from the carrier through a wire screen (45μ opening). The Q/M values were calculated from the charge measured on the electrometer and the weight loss after blowoff. The results are shown in the table below.

TABLE

| | | % Sulfonated Copolymer | Q/M (microcoulombs/gm)* |
|---|---|---|---|
| Toner A - | Sample 1 | 0.5% | −7.1 |
| | Sample 2 | 1.0% | −8.4 |
| | Sample 3 | 1.5% | −11.5 |
| Toner B - | Sample 1 | 0.5% | −9.9 |
| | Sample 2 | 1.0% | −14.5 |
| | Sample 3 | 1.5% | −16.2 |

*Corrected for Q/M of binder

The toner of the present invention was also tested in a charge spectrometer where the charge on the toner was measured against percent mass, and essentially all of the toner (e.g., 99.7%) exhibited a negative charge.

Although this invention has been described with respect to specific embodiments, the details thereof are not to be construed as limitations for it will be apparent that various embodiments, changes, and modifications may be resorted to without departing from the spirit and scope thereof, and it is understood that such equivalent embodiments are intended to be included within the scope of this invention.

We claim:

1. A toner for developing latent electrostatic images comprising:

(a) about 88 to about 98.5 weight % of a binder copolymer comprising styrene and an acrylate ester; and (b) about 0.1 to about 5 weight % of a negatively chargeable copolymer comprising sulfonated styrene and acrylate ester, each copolymer independently having a molecular weight from about 60,000 to about 120,000.

2. The toner of claim 1, wherein said toner contains a colorant.

3. The toner of claim 2, wherein the acrylate ester of the chargeable copolymer is the same as the acrylate ester of the binder copolymer.

4. The toner of claim 3, wherein said negatively chargeable copolymer has a molecular weight substantially equal to the molecular weight of the binder copolymer.

5. The toner of claim 4, wherein said acrylate ester is alkyl (meth)acrylate or alkyl acrylate.

6. The toner of claim 5, wherein said toner comprises about 88 to about 90 weight % of said binder copolymer, about 0.5 about 1.5 weight % of said chargeable copolymer, and about 1 to about 11.5 weight % of said colorant.

7. The toner of claim 6, wherein said binder copolymer comprises about 50 to about 70 weight % of styrene, and about 50 to about 30 weight % of acrylate ester.

8. The toner of claim 7, wherein about 1% to about 20% of the styrene of the chargeable copolymer is sulfonated.

9. The toner of claim 8, wherein said toner has a particle size of about 1 to about 20 microns.

10. The toner of claim 9, wherein said acrylate ester is butyl acrylate.

11. The toner of claim 9, wherein said acrylate ester is 2-butyl methacrylate.

12. A developer for developing latent electrostatic images comprising:

(a) a carrier; and (b) a toner comprising about 88 to about 98.5 weight % of a binder copolymer comprising styrene and acrylate ester, and about 0.1 to about 5 weight % of a negatively chargeable compolymer comprising sulfonated styrene and acrylate ester, each copolymer independently having a molecular weight from about 60,000 to about 120,000.

13. The developer of claim 12, wherein said developer contains a colorant.

14. The developer of claim 13, wherein the acrylate ester of the chargeable copolymer is the same as the acrylate ester of the binder copolymer.

15. The developer of claim 14, wherein said negatively chargeable copolymer has a molecular weight substantially equal to the molecular weight of the binder copolymer.

16. The developer of claim 15, wherein said acrylate ester is alkyl acrylate.

17. The developer of claim 15, wherein said acrylate ester is alkyl methacrylate.

* * * * *